US006571919B1

(12) United States Patent
Stewart

(10) Patent No.: US 6,571,919 B1
(45) Date of Patent: Jun. 3, 2003

(54) REMOVABLE CYLINDER ARRANGEMENT FOR LIFT

(75) Inventor: Jason Stewart, Madison, IN (US)

(73) Assignee: Delaware Capital Formation Inc., Madison, IN (US)

( * ) Notice: Subject to any disclaimer, the term of this patent is extended or adjusted under 35 U.S.C. 154(b) by 0 days.

(21) Appl. No.: 09/884,673

(22) Filed: Jun. 19, 2001

(51) Int. Cl.[7] ..... B66F 7/10
(52) U.S. Cl. ..... 187/215; 187/205; 187/272
(58) Field of Search ..... 187/204, 205, 187/210, 215, 216, 218, 219, 272–275; 254/92, 98

(56) References Cited

U.S. PATENT DOCUMENTS

| | | | | |
|---|---|---|---|---|
| 1,919,156 A | | 7/1933 | Banning, Jr. | |
| 1,985,510 A | * | 12/1934 | Lunati | 187/215 |
| 2,844,218 A | * | 7/1958 | Hott | 187/218 |
| 3,279,562 A | * | 10/1966 | Farrell | 187/215 |
| 3,489,248 A | * | 1/1970 | Clarke | 187/215 |
| 4,452,340 A | * | 6/1984 | Hernick et al. | 187/215 |
| 5,143,179 A | | 9/1992 | Hornstein | |
| 5,501,296 A | * | 3/1996 | Fletcher | 187/210 |
| 5,573,083 A | * | 11/1996 | Fletcher et al. | 187/205 |
| 5,678,253 A | | 10/1997 | Baker | |

FOREIGN PATENT DOCUMENTS

| | | | | |
|---|---|---|---|---|
| AU | 20760 | * | 4/1930 | 187/215 |
| DE | 1209268 | * | 1/1966 | 187/215 |
| DE | 4028484 | * | 3/1992 | |
| FR | 1379190 | * | 10/1964 | 187/215 |
| GB | 1072375 | * | 6/1967 | 187/215 |
| JP | 402147585 | * | 6/1990 | 187/272 |
| JP | 406183667 | * | 7/1994 | 187/272 |

OTHER PUBLICATIONS

Drawing of Lift by Nussbaum on Sale Prior to Jun. 19, 2001.

* cited by examiner

*Primary Examiner*—Dean J. Kramer
*Assistant Examiner*—Paul T. Chin
(74) *Attorney, Agent, or Firm*—Theresa Fritz Camoriano; Camoriano and Associates

(57) ABSTRACT

An in-ground lift assembly that is easy to maintain, because the cylinder unit is easily removed from the lift simply by removing a portion of the movable frame near the top of the lift and then lifting the cylinder unit out of the lift intact.

17 Claims, 12 Drawing Sheets

REMOVABLE CYLINDER ARRANGEMENT FOR LIFT

BACKGROUND OF THE INVENTION

In-ground lifts are well-known in the art. These lifts are usually enclosed in a containment housing, which is substantially closed on its bottom and sides and open on its top. One problem with these lifts is that it is difficult to remove a cylinder for maintenance. Usually, in order to remove the cylinder, the lift and/or the cylinder must be substantially disassembled, which requires a significant amount of down-time, manpower, and use of heavy equipment. Disassembly also permits dirt and air to enter the inside of the cylinder, which is undesirable.

SUMMARY OF THE INVENTION

The present invention provides a cylinder arrangement in which maintenance is much easier than in prior art in-ground lifts, saving significant amounts of down-time and manpower.

In a lift made in accordance with the present invention, the closed and sealed cylinder unit is installed so that it rests on the fixed frame of the lift by gravity and is trapped between the fixed frame and a removable portion of the movable frame. There are no connections or fittings between the cylinder unit and the stationary lift frame at the bottom of the stationary lift frame which must be disconnected in order to remove the cylinder unit from the lift. Thus, the cylinder unit can readily be removed from the lift as an intact unit for repair or replacement.

DESCRIPTION OF THE PREFERRED EMBODIMENTS

Figure 1:
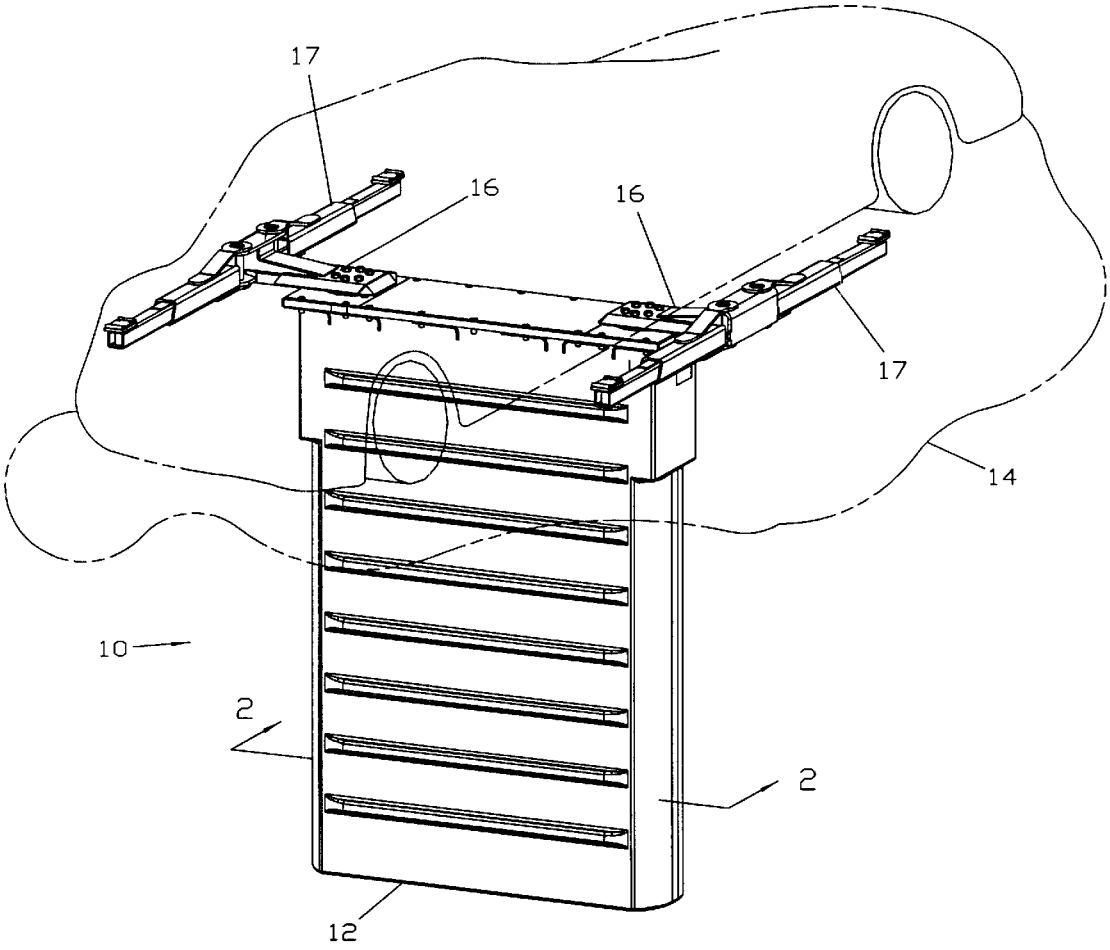
FIG. 1 is a perspective view of an example of a twin plunger lift made in accordance with the present invention, including the shop floor and an automobile in phantom.

FIG. 1 is an example of a first preferred embodiment of a twin plunger lift 10 made in accordance with the present invention. The lift 10 includes a containment housing 12, which is located below the level of the shop floor or ground 14, and it includes superstructures or vehicle support platforms 16, which are located just above ground level, so that a vehicle can drive over the lift 10, and the arms 17, attached to the superstructures 16, can be positioned at the correct points on the vehicle before lifting the vehicle. The containment housing 12 is closed on its bottom and sides in order to protect the lift mechanism from the corrosive and electrolytic sub-soil environment and to contain any spill of hydraulic fluid that may occur from the lift mechanism located inside the housing 12. The top of the housing 12 is open, which permits the lift 10 to raise the superstructures or vehicle support platforms 16 up and down in order to raise and lower the vehicle.

Figure 2:
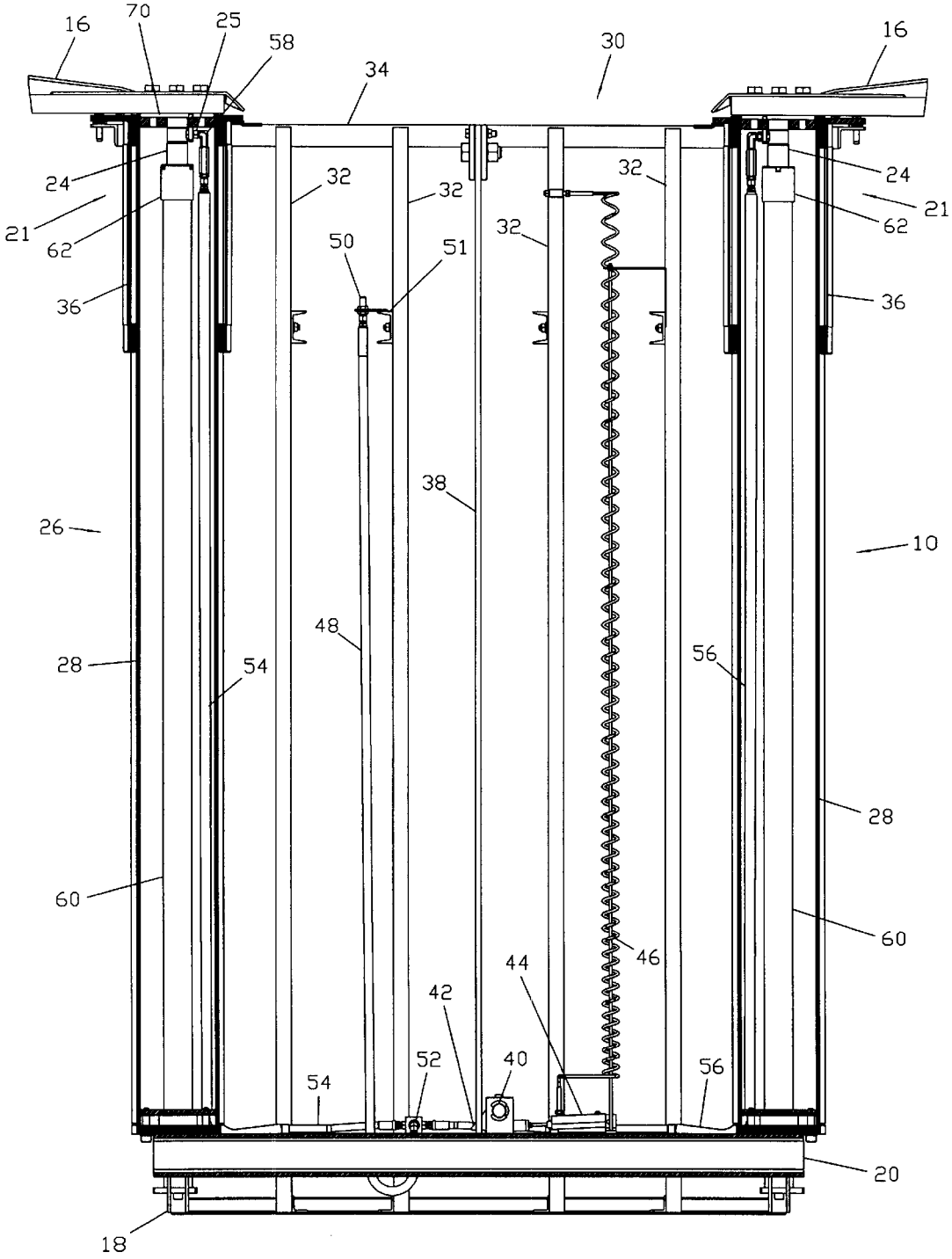
FIG. 2 is a schematic view of the lift of FIG. 1, taken along the line 2—2, with the containment housing removed.
Figure 2A:
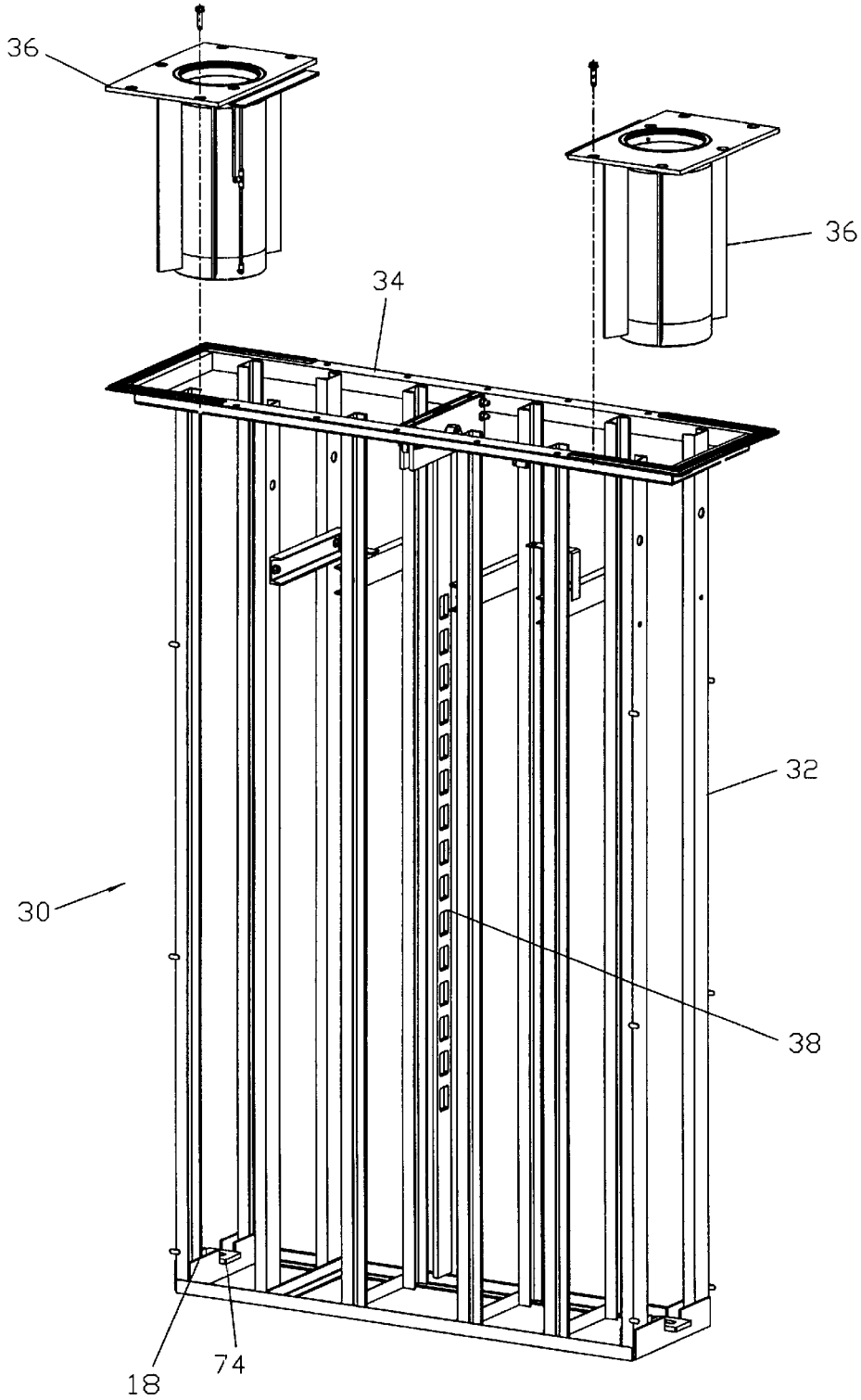
FIG. 2A is a perspective view of the stationary frame portion of FIG. 2, with the two guide barrels exploded above the rest of the stationary frame.
Figure 2B:
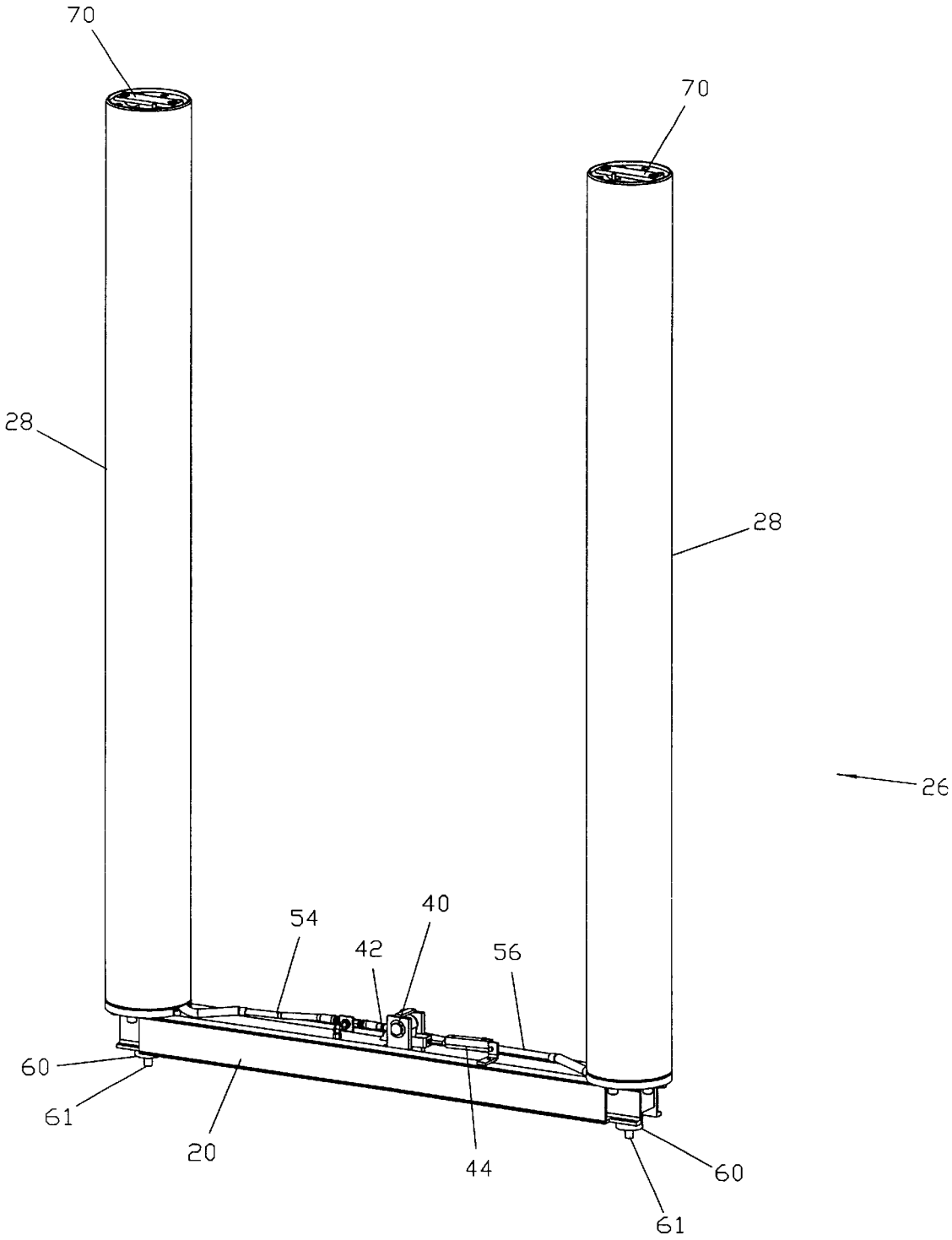
FIG. 2B is a perspective view of the movable frame portion of FIG. 2.
Figure 2C:
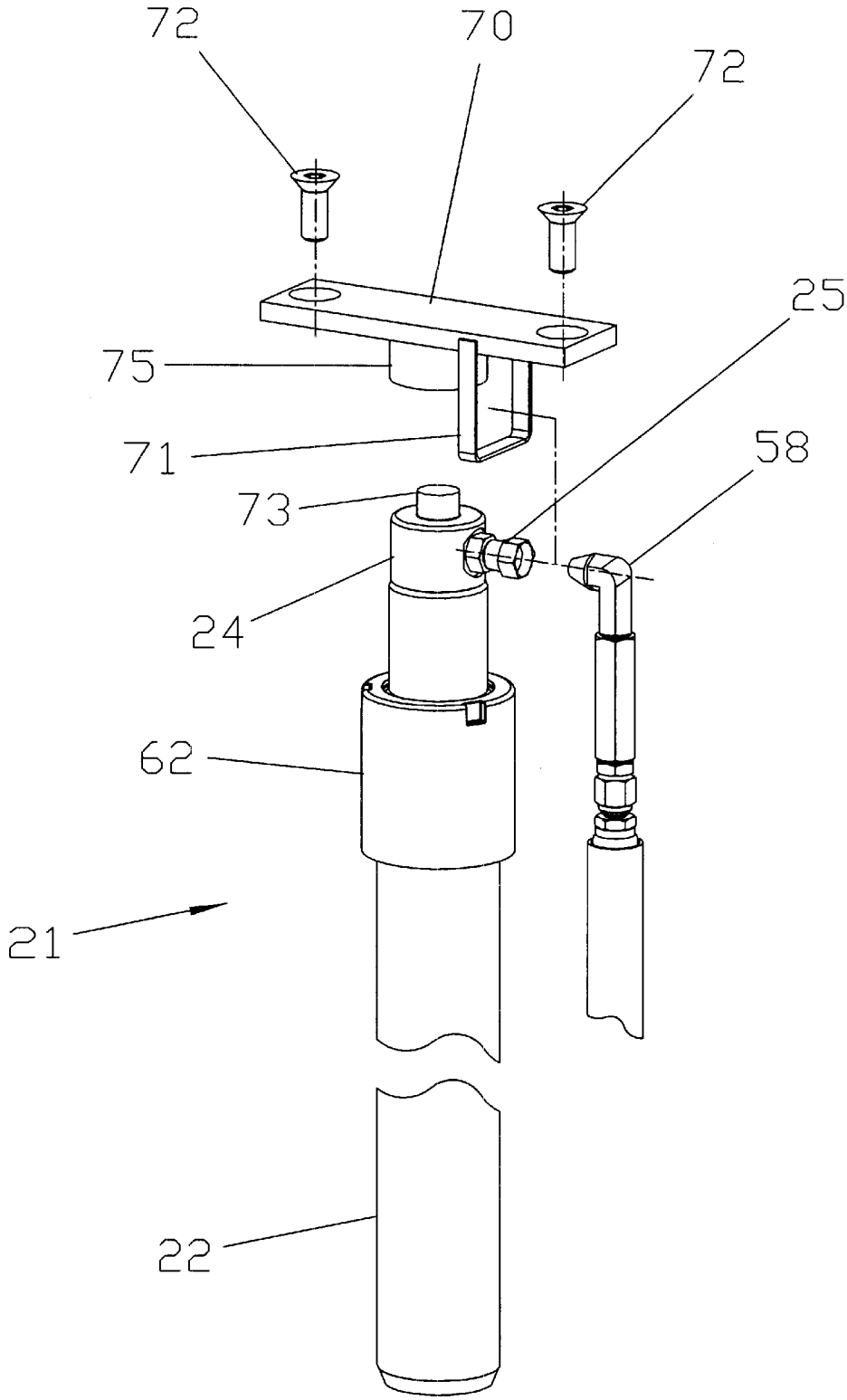
FIG. 2C is a schematic view of the cylinder and tie bar of FIG. 2.

FIG. 2 shows what is inside the containment housing 12. The lift includes a stationary frame 30, shown in FIG. 2A, and a movable frame 26, shown in FIG. 2B, which moves up and down relative to the stationary frame 30. At the bottom of FIG. 2 is the stationary frame base 18. Above the frame base 18 is an equalizer beam 20, which is part of the movable frame 26. The equalizer beam 20 ties the two plungers 28 together to ensure that they move together. Left and right cylinder units 21 (shown better in FIG. 2C), are supported by the frame base 18 via the support tubes 60 (shown better in FIGS. 3–4A). Each cylinder unit 21 includes a cylinder casing 22 and a cylinder rod 24 movably mounted inside its cylinder casing 22. The volume between the hollow cylinder rod 24 and the cylinder casing 22 defines an expandable fluid chamber, which becomes larger as it fills with fluid and raises the lift, and which becomes smaller as fluid leaves and the lift descends. Left and right movable cylinder rods 24 project out the top of their respective cylinder casings 22. Each of the cylinder units 21 is trapped or sandwiched between the movable frame 26 and the stationary frame 30. The movable frame 26 (shown better in FIG. 2B), moves up and down with the cylinder rods 24 as they move within their respective cylinder casings 22. The movable frame 26 (shown best in FIG. 2B) includes left and right plungers 28 (which surround the cylinder casings 22), the equalizer beam 20, which is secured to the plungers 28, the left and right tie bars 70 (shown better in FIGS. 2C and 3), and the left and right superstructures 16.

The stationary frame 30 (shown better in FIG. 2A) includes the guide barrels 36, which guide and laterally support the movable frame (or lifting assembly) 26. The stationary frame 30 includes the frame base 18, the frame top 34, and a plurality of uprights 32, which secure the frame base 18 to the frame top 34. The stationary frame 30 also includes the latch bar 38, which has a pattern of notches (shown in FIG. 2A) that are engaged by a locking latch 42, at various positions along the latch bar 38 as the lifting assembly moves up and down.

A locking latch assembly 40 is fixed to the equalizer beam 20 and rides up and down as the movable frame or lifting assembly 26 moves up and down. The locking latch assembly 40 includes a pivoting latch 42, which projects through notches in the latch bar 38, in a manner that is well known in the art, in order to support the weight of the lift at various heights. The locking latch assembly 40 is controlled by an air cylinder 44, powered through a coiled hose 46, which is connected to a compressed air source (not shown).

A fluid line 48 has an inlet 50, which is connected to a source of pressurized fluid (not shown). In this preferred embodiment, the pressurized fluid is hydraulic fluid. The inlet 50 is mounted on an upright 32 by means of a bracket 51. The fluid line 48 extends downwardly until it reaches a "T" connector 52, and two lines 54, 56 leave the T connector to supply fluid to the two cylinder units 21. Since both the left and right cylinder units 21 operate in the same manner, this description will describe only the left cylinder unit 21.

Figure 3:
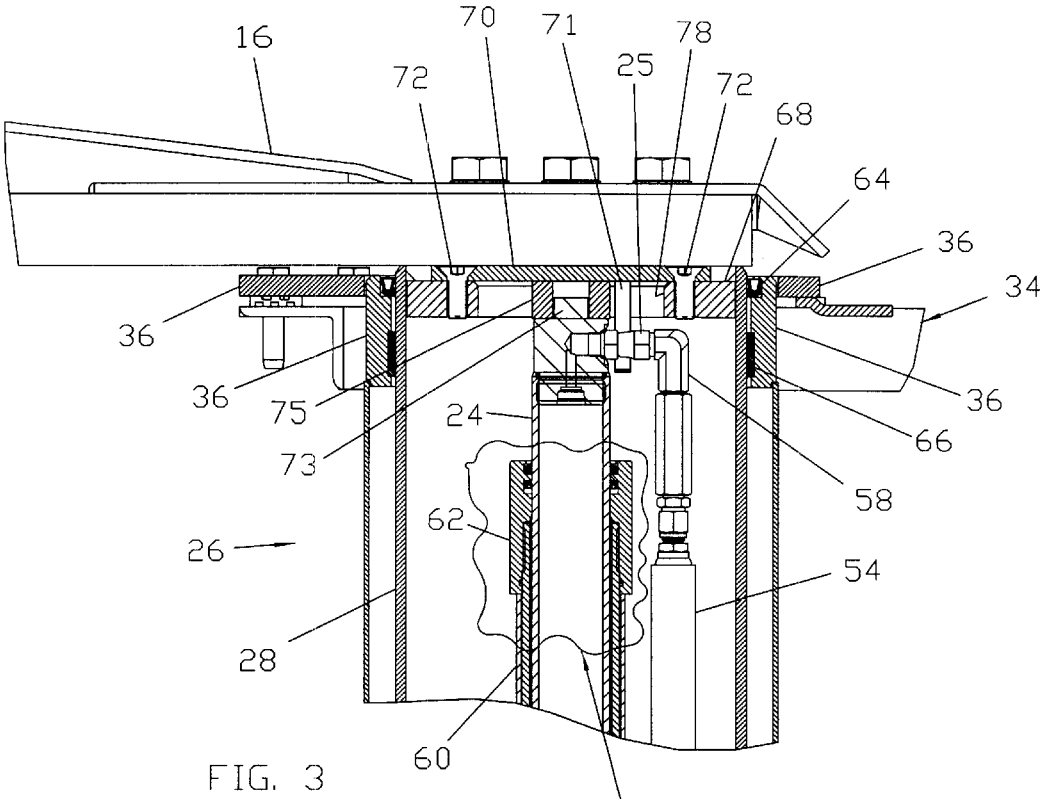
FIG. 3 is an enlarged view of the upper left portion of FIG. 2.

The left fluid line 54 enters inside the left plunger 28 near the bottom of the plunger 28 (shown better in FIG. 4) and extends up inside the plunger 28 to the elbow fitting 58 connected to the cylinder rod fitting 25 at the top of the cylinder rod 24 (see FIG. 3). Thus, fluid may pass from its source, through the inlet 50, through the lines 48 and 54 to the fitting 58 connected to the cylinder rod fitting 25, and into the hollow cylinder rod 24 to power the left cylinder unit 21.

Figure 3B:
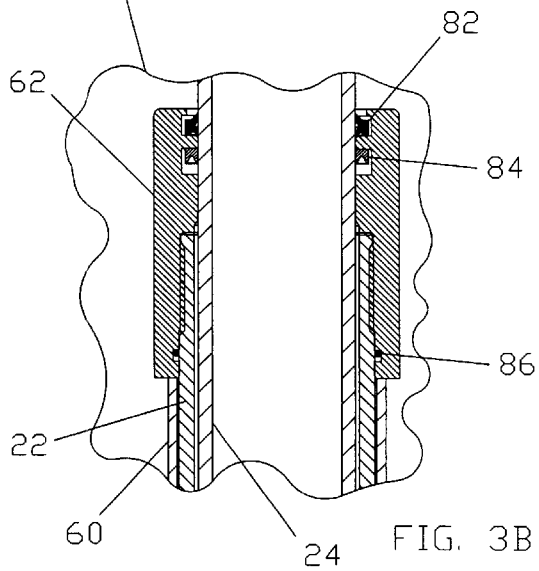
FIG. 3B is an enlarged view of the gland portion of FIG. 3.
Figure 3A:
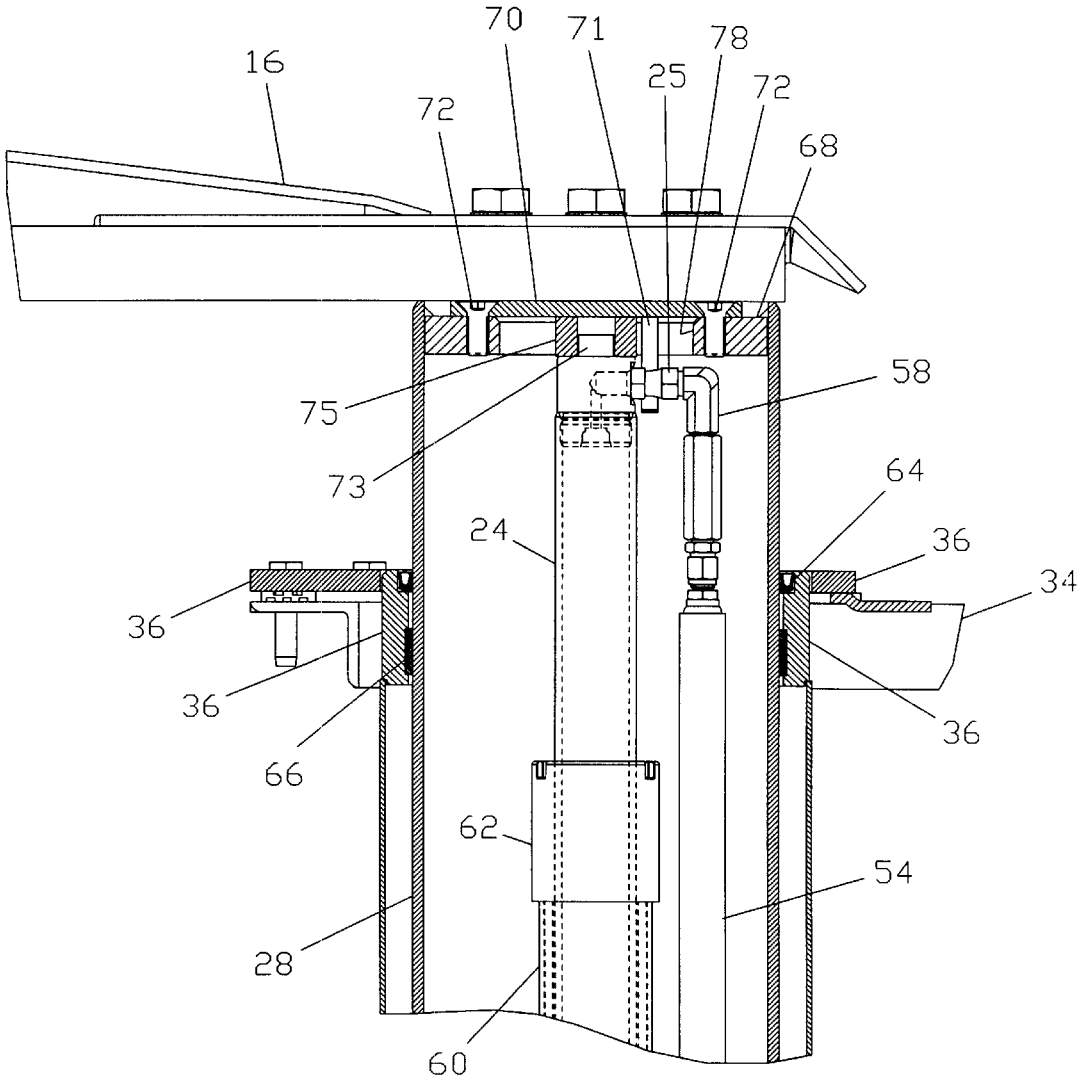
FIG. 3A is the same view as FIG. 3 but with the lift raised a short distance.

FIGS. 3 and 3A show the upper left portion of FIG. 2 in more detail, and FIG. 3B is an enlargement of the gland portion of FIG. 3. These figures show the movable plunger 28 and the fluid line 54 extending up inside the plunger 28. There is a support tube 60, which supports the cylinder unit 21. The cylinder casing 22 includes a gland 62 (a larger diameter portion), and the majority of the cylinder casing 22 extends down into the support tube 60, with the bottom of the gland 62 of the cylinder casing 22 resting on the top of the support tube 60. The gland 62 preferably is threaded onto the cylindrical portion of the casing 22, as shown in FIG. 3B. FIG. 3B also shows a wiper 82 and a seal 84 between the casing 22 and the cylinder rod 24. The cylinder rod 24 is hollow, so the pressurized fluid, which enters the cylinder rod 24 through the cylinder inlet (the cylinder rod fitting 25) near the top of the cylinder rod, passes through the hollow cylinder rod 24. This fluid exits the bottom of the cylinder rod 24 and exerts pressure against the cylinder rod 24 and against the cylinder casing 22 in order to raise the cylinder rod 24 relative to the cylinder casing 22.

The guide barrel 36 (also shown in 2A) is shown in more detail in FIG. 3, and it can be seen that there is a seal 64, and a bearing 66, on the inner surface of the guide barrel 36, which guides the plunger 28 as it travels up and down.

A plate 68 is affixed to the inner surface of the plunger 28 near the top of the plunger 28, preferably by threading or welding. A tie bar 70 is secured to the plate 68, preferably by means of threaded fasteners 72. The tie bar 70 extends across the central opening in the plate 68. The tie bar 70 includes a downwardly-projecting inverted cup 75 and a strap or loop 71. The tie bar cup 75 receives an upward protrusion 73 from the cylinder rod 24, which centers the cylinder rod 24 relative to the tie bar 70. The strap or loop 71 encircles the fluid fitting 25 near the top of the cylinder unit 21 to permit the tie bar 70 to serve as a handle for lifting the cylinder unit 21 out of the lift 10.

The superstructure 16 is also secured to the plate or bolting ring 68 on top of the plunger 28. The tie bar 70 and superstructure 16 are portions of the movable frame or lifting frame 26 that can be removed in order to gain access to the cylinder unit 21, as will be described later.

FIG. 3A shows the same portion of the lift as FIG. 3, but the lift has been raised a short distance. It can be seen in this view that the movable frame or lifting assembly 26, including the plunger 28 and the superstructure 16, moves up with the cylinder rod 24. The fluid line 54 also travels up and down with the cylinder rod 24.

Figure 4:
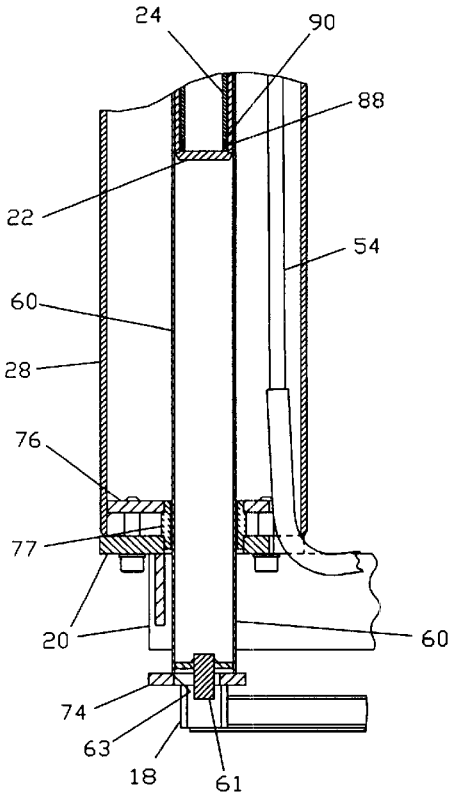
FIG. 4 is an enlarged view of the lower left portion of FIG. 2.
Figure 4A:
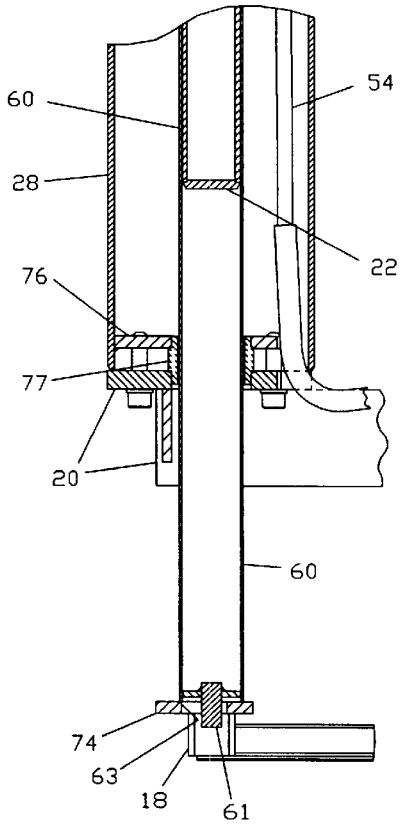
FIG. 4A is the same view as FIG. 4 but with the lift raised a short distance.

FIGS. 4 and 4A show the bottom portion of the plunger 28. Here it can be seen that the bottom of the support tube 60 rests on the support plate 74, which is fixed to the stationary frame base 18. A protrusion 61 on the bottom of the support tube 60 is received in a slot 63 in the support plate 74 in order to locate the support tube 60 on the frame base 18. The bottom of the cylinder casing 22 and the bottom of the retracted cylinder rod 24 are shown in the upper portion of FIG. 4. The cylinder casing 22 does not extend all the way down to the support plate 74, so the support tube 60 serves as a spacer for the cylinder unit 21. It would, of course, be possible for the cylinder casing 22 to extend all the way down to the support plate 74, but the present arrangement permits a common cylinder unit 21 to be used, thus making the arrangement less expensive. There is also a lower end plate 76 affixed to the inner surface of the plunger 28 near the bottom of the plunger 28, and a bushing 77 is contained between the end plate 76 and the equalizer beam 20. The inner diameter of the bushing 77 guides along the outer surface of the support tube 60, providing additional fore and aft support to the movable frame or lifting assembly 26. The equalizer beam 20 is secured to the plungers 28 and travels up and down with the plungers 28, while the support tube 60 and frame base 18 remain stationary. The plunger 28 surrounds the support tube 60 and the cylinder unit 21, all of which preferably have the same longitudinal axis. It will be noted in FIG. 4A that the cylinder rod 24 is no longer visible, as it has moved upward relative to the cylinder casing 22, taking the plunger 28, fluid line 54, equalizer beam 20, bushing 77, and end plate 76, up with it.

In order to raise the lift, pressurized fluid is pumped through the fluid line 54. In order to lower the lift, the pressure is released, and the fluid is allowed to return to a tank (not shown) as the lift moves down.

Figure 5:
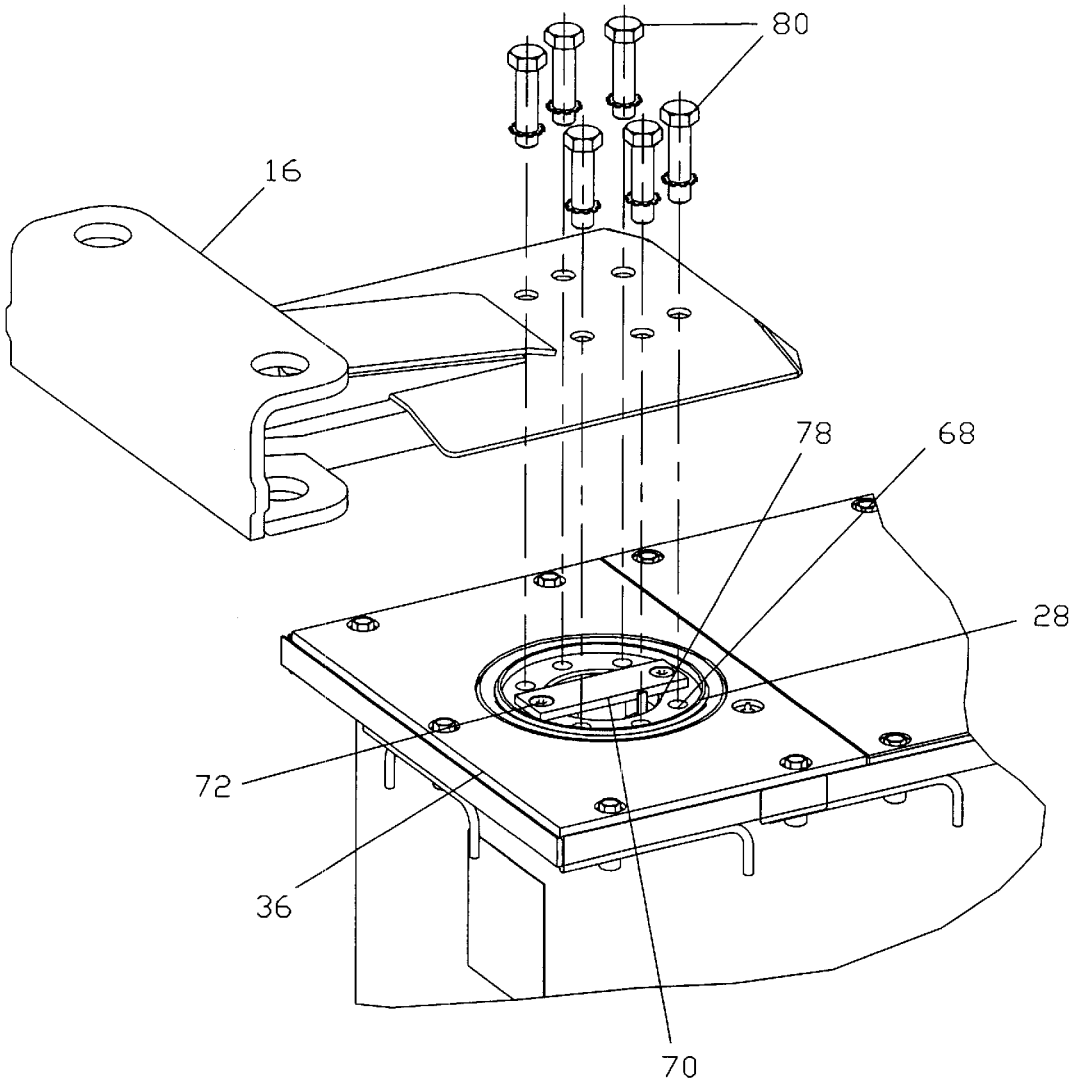
FIG. 5 is a perspective view of the upper left portion of the lift of FIG. 1 with the superstructure exploded above the plunger.
Figure 6:
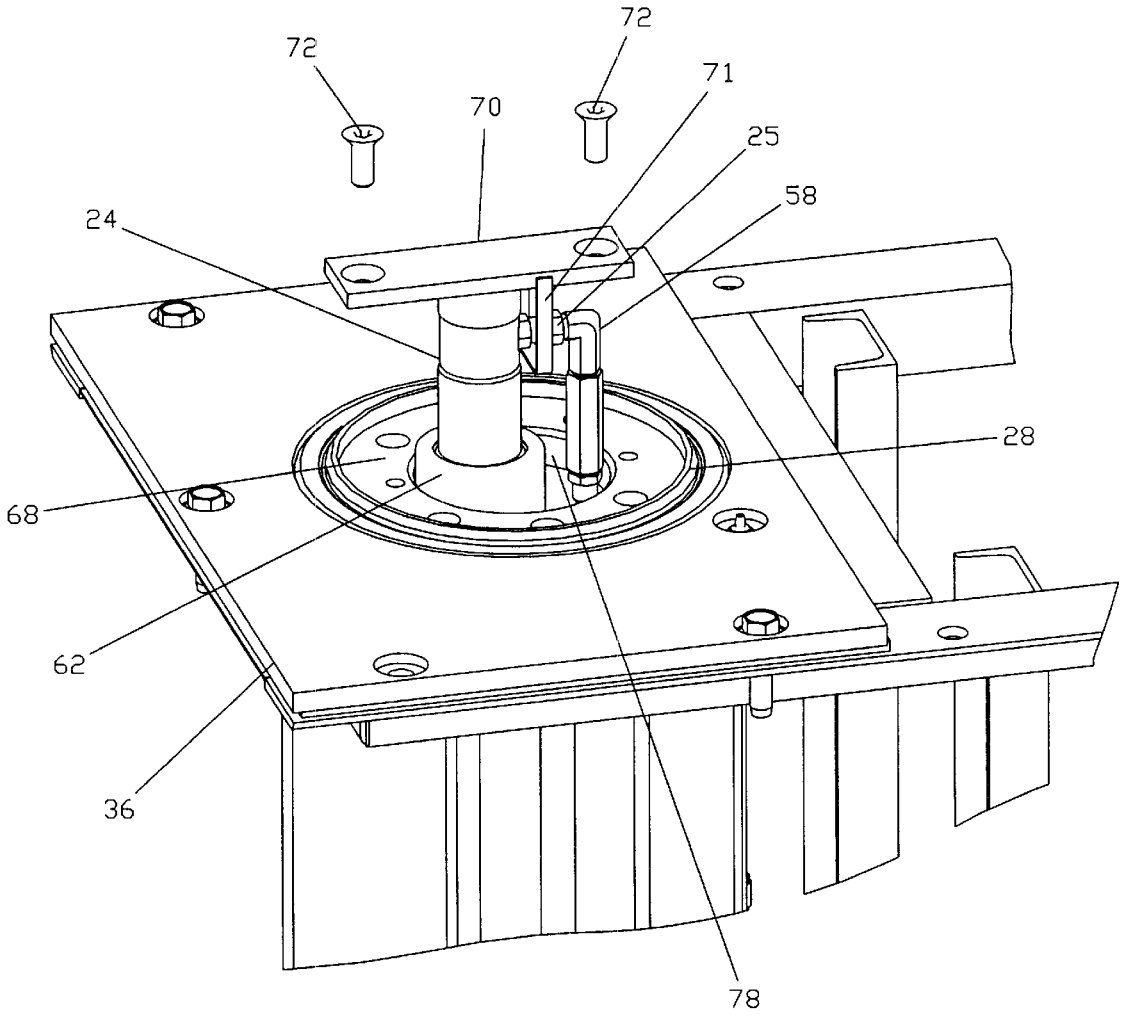
FIG. 6 is substantially the same view as FIG. 5, but showing the cylinder unit partially lifted out of the lift.

FIGS. 5–6 are views of the upper left portion of the lift 10, taken from outside the lift. FIG. 5 shows the plunger 28 retracted and the superstructure 16 exploded. The superstructure 16 had been secured to the plate 68 by threaded fasteners 80. As shown in FIG. 6, the plate or bolting ring 68 has a central opening 78 through which the cylinder unit 21 can pass in order to remove the cylinder unit 21 or to replace the cylinder unit.

In order to remove an intact cylinder unit 21 for replacement or maintenance, a very simple procedure is followed. Two removable portions of the movable frame 26 must be removed—namely, the superstructure 16 and the tie bar 70. First, the fasteners 80 are removed, and the superstructure 16 is removed. Then, the fasteners 72 are removed, and the tie bar 70 is rolled slightly, pivoting the strap 71 around the fitting 25 to allow access to the fittings. Then, the elbow fitting 58 is disconnected from the cylinder rod fitting 25, and the intact cylinder unit 21 is lifted out of the plunger 28 through the central opening 78 along with the tie bar 70, which may be used as a handle to lift the assembly.

In order to replace a cylinder unit 21, the cylinder unit is inserted through the central opening 78 and into the top of the support tube 60 until the gland 62 of the cylinder casing 22 rests on the top of the support tube 60. The tie bar 70 is placed on the end of the cylinder rod 24, with the affixed tie bar loop 71 placed over the cylinder rod fitting 25. Then the elbow fitting 58 is connected to the cylinder rod fitting 25. The tie bar 70 is then fastened to the plate or bolting ring 68, and the superstructure 16 is then installed on top of the plunger 28, and the lift is again ready to operate.

Since the hollow cylinder rod 24 extends upwardly out of the cylinder casing 22, and the fitting 25 is at the top of the cylinder rod 24, the system is self-bleeding. In addition to constraining the cylinder rod 24 from movement in rotational and translational directions separate from the plunger 28, the tie bar 70 with the affixed loop 71 also allows the lift to be operated, with no vehicular load, without the superstructure 16 installed. The cylinder rod 24 could just as well push against the bottom of the superstructure 16, if used in conjunction with a spacer, to raise the plunger 28 and superstructure 16, as it can push against the bottom of the tie bar 70 to raise the plunger and superstructure 16, so the tie bar 70 is not required.

Figure 1A:
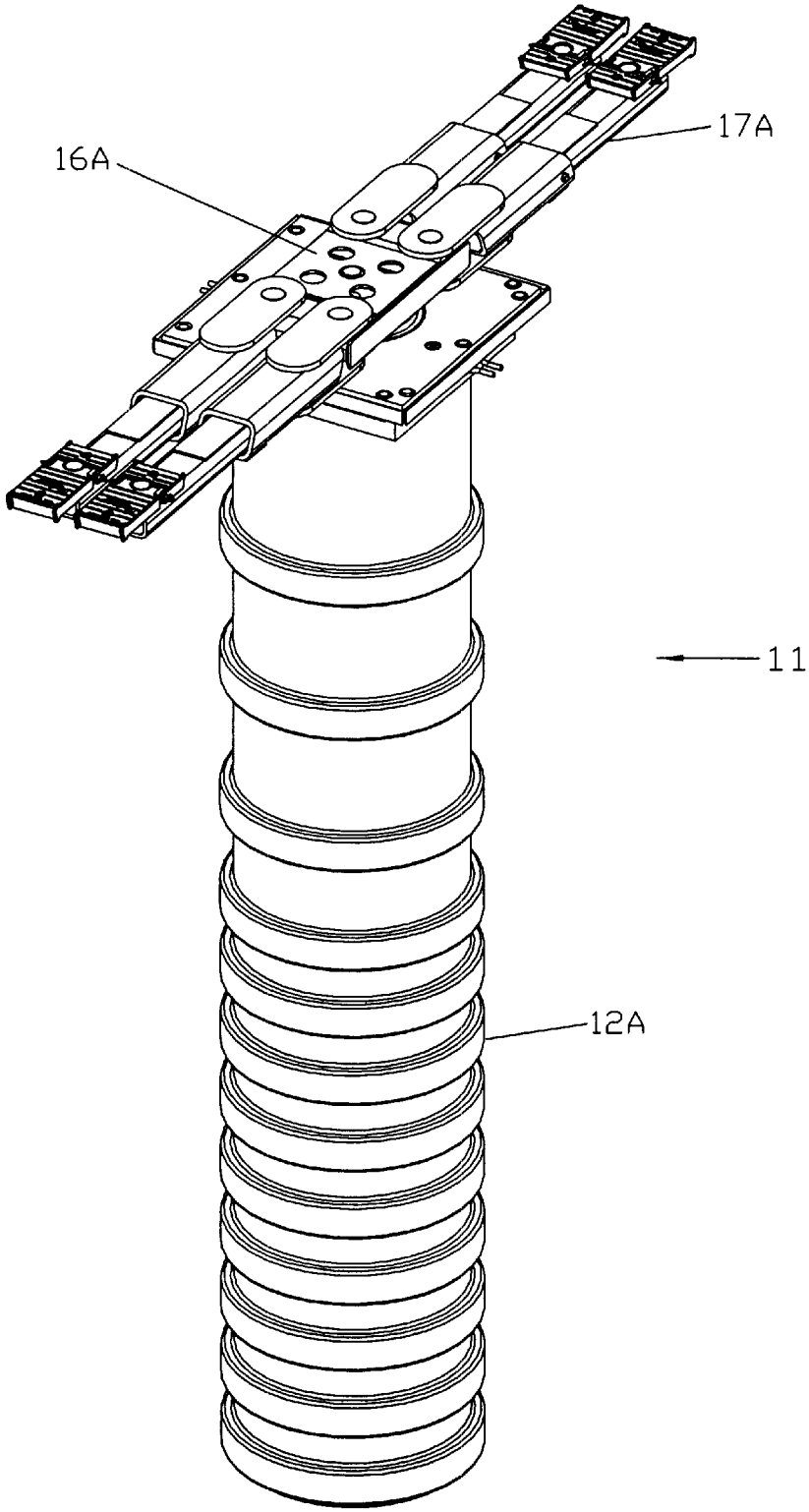
FIG. 1A is a perspective view of an example of a single plunger lift made in accordance with the present invention.

FIG. 1A is an example of a second preferred embodiment. This embodiment uses a single plunger lift 11 made in accordance with the present invention. This single plunger lift 11 is very similar to the two cylinder lift described in detail above, except that it has only a single cylinder rather than two, and its housing 12A is more cylindrical in shape, while the housing of the two-cylinder lift is more box-like. Also, both sets of arms 17A are mounted on the same vehicle support platform 16A in this embodiment.

Figure 7:
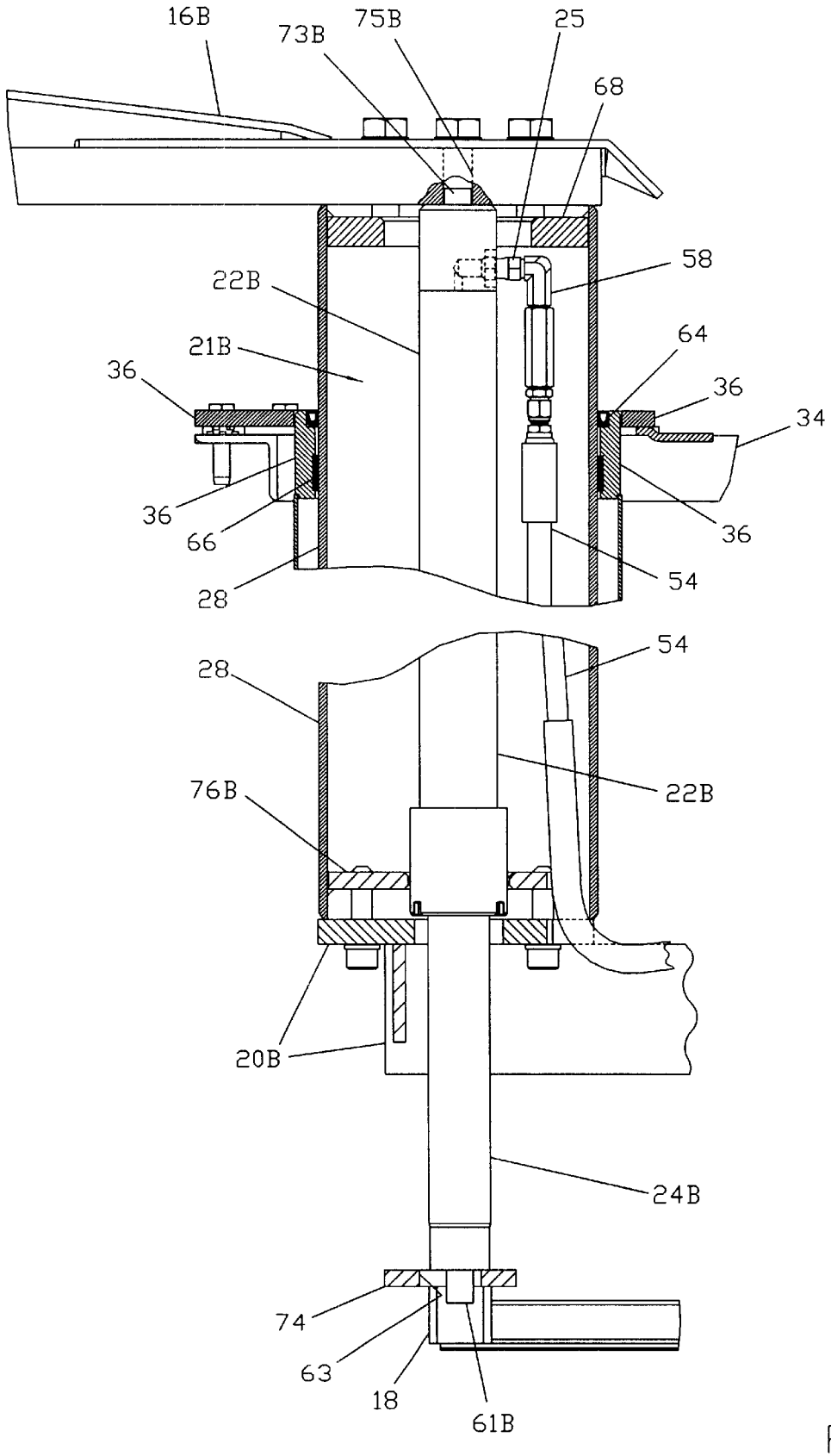
FIG. 7 is a broken away section view through one cylinder portion of a third embodiment of a lift made in accordance with the present invention.

FIG. 7 shows a third embodiment of a lift made in accordance with the present invention. This view is similar to a combination of FIGS. 3 and 4 for the first preferred embodiment, showing the left side of a two-cylinder lift. This embodiment differs from the first embodiment in that the cylinder unit 21B is inverted, with the cylinder rod 24B projecting downwardly and the cylinder casing 22B extending upwardly. In this case, the cylinder rod 24B is supported on the stationary frame, with the projection 61B from the cylinder rod 24B extending into a slot 63 in the stationary frame base, and the cylinder casing 22B moves up and down, carrying the movable frame with it. The top of the cylinder casing 22B is centered by means of a projection 73B on the top of the cylinder casing 22B, which is received in a recess in the superstructure 16B. Again, the fluid fitting 25 is near the top of the cylinder unit 21B, so the cylinder unit 21B can be removed from the lift simply by removing the lift platform 16B, disconnecting the fitting 58 from the fitting 25, and lifting the intact cylinder unit 21B from the lift.

While particular types of fastening arrangements, such as welding and threaded fasteners are shown herein as the preferred methods of fastening the parts together, many types of fastening arrangements are known in the art and could be used without departing from the scope of the present invention. Also, while cylinder rods without pistons have been shown here, it would also be possible to use cylinder rods with pistons and for the cylinder rods to be hollow or solid.

The preferred embodiments described above are understood simply to be examples of what are currently believed to be the best ways of carrying out the invention. Applicant and others may deviate from and improve upon these embodiments without departing from the scope of the invention. Applicant has not attempted to show herein every possible version of the invention that is intended to be protected by the claims, as this would be impossible, and it is not required in order to obtain a patent that protects the full scope of the invention. While some alternatives have been mentioned in this specification, it would be obvious to those skilled in the art to make many other modifications to this embodiment without departing from the scope of the claimed invention. Therefore, these examples should not be considered to add any limitations beyond the limitations of the plain meaning of the claims, unless the words in the claims have clearly been given a special definition herein.

What is claimed is:

1. An in-ground lift, comprising:

a stationary frame;

a first stationary cylinder casing having a top and a bottom; and a first movable hollow cylinder rod mounted inside said cylinder casing, wherein said first cylinder casing is supported on said stationary frame, and wherein said first movable hollow cylinder rod extends upwardly, projecting out the top of said first stationary cylinder casing;

a movable frame supported on said movable cylinder rod; said movable frame including a vehicle support platform; and a first movable fluid conduit, connected near the top of said first movable cylinder rod;

wherein, as pressurized fluid enters said first movable cylinder rod through said fluid conduit, it causes said first cylinder rod and movable frame to move upwardly relative to said stationary frame, and wherein said movable frame includes a first hollow plunger, which surrounds said first cylinder casing.

2. An in-ground lift as recited in claim 1, and further comprising a second cylinder casing, a second cylinder rod located inside said second cylinder casing, a second plunger mounted for movement with said second cylinder rod and surrounding said second cylinder casing, a second fluid conduit including a fitting near the top of said second cylinder rod, and an equalizer beam mounted between said first and second plungers so that said first and second plungers move together as said first and second cylinder rods move up and down in their respective cylinder casings.

3. An in-ground lift as recited in claim 2, wherein said first and second cylinder casings include an enlarged outside diameter portion near their top end, and further comprising first and second support tubes resting on said stationary frame, wherein said first and second cylinder casings project into said first and second support tubes, with said enlarged outside diameter portions resting on the top of said first and second support tubes, respectively.

4. An in-ground lift as recited in claim 2, and further comprising first and second plates affixed to the top end of said first and second plungers, respectively, each of said plates defining a central opening through which its respective cylinder casing and cylinder rod can pass in order to be lifted out of its respective plunger.

5. An in-ground lift as recited in claim 4, and further comprising first and second tie bars, each of which extends cross the central opening of its respective plate and is secured to its respective plate.

6. An in-ground lift as recited in claim 1, wherein said plunger has a plate fixed to its top end, said plate defining a central opening through which said first cylinder casing and cylinder rod can pass in order to be lifted out of said plunger.

7. An in-ground lift as recited in claim 6, and further comprising a first tie bar, extending across the central opening of said plate and secured to said plate.

8. An in-ground lift, comprising:

a stationary frame;

a first stationary cylinder casing having a top and a bottom; and a first movable hollow cylinder rod mounted inside said cylinder casing, wherein said first cylinder casing is supported on said stationary frame, and wherein said first movable hollow cylinder rod extends upwardly, projecting out the top of said first stationary cylinder casing;

a movable frame supported on said movable cylinder rod; said movable frame including a vehicle support platform; and a first movable fluid conduit, connected near the top of said first movable cylinder rod;

wherein, as pressurized fluid enters said first movable cylinder rod through said fluid conduit, it causes said first cylinder rod and movable frame to move upwardly relative to said stationary frame, and wherein said first cylinder casing defines an enlarged outside diameter portion; and further comprising a first support tube having a top and bottom, wherein the bottom of said first support tube rests on said stationary frame, and said first cylinder casing projects downwardly into said first support tube, with said enlarged outside diameter portion of said cylinder casing resting on the top of said support tube.

9. An in-ground lift, comprising:

a stationary frame;

first and second cylinder assemblies each including a cylinder casing having a top and a bottom and supported on said stationary frame; and first and second movable hollow cylinder rods defining a hollow interior and projecting out of the top of said first and second cylinder casings, respectively;

a movable frame supported on said first and second cylinder rods; and fluid supply lines in fluid communication with the interior of said first and second hollow cylinder rods and connected to said cylinder rods near the top of said cylinder rods; and further comprising first and second support tubes; each of said support tubes being supported on said stationary frame, wherein each of said cylinder casings projects into its respective support tube and includes an enlarged outside diameter portion that rests on top of its respective support tube.

10. An in-ground lift, comprising:

a stationary frame;

a movable frame, including a first plunger and a vehicle support platform;

a first closed and sealed cylinder unit surrounded by said first plunger, including a first cylinder casing, and a first cylinder rod extending into said first cylinder casing and projecting out of said first cylinder casing, wherein said cylinder unit defines an expandable fluid chamber; and a first inlet port near the top of said closed and sealed cylinder unit in fluid communication with said expandable fluid chamber;

wherein one of said first cylinder rod and said first cylinder casing is a stationary cylinder member, supported on said stationary frame, and the other of said first cylinder rod and said first cylinder casing is a movable cylinder member, which lifts said movable frame; and wherein, as pressurized fluid enters said expandable fluid chamber of said first closed and sealed cylinder unit through said first inlet port, it causes said movable cylinder member and said movable frame to move upwardly relative to said stationary frame; and wherein said movable frame includes a removable portion near the top of said lift, and said first closed and sealed cylinder unit is trapped between said removable portion and said stationary frame, such that, after said removable portion is removed, said first closed and sealed cylinder unit can be lifted intact out of said lift.

11. An in-ground lift as recited in claim 10, wherein said first closed and sealed cylinder unit is mounted on said stationary frame by means of gravity.

12. An in-ground lift as recited in claim 10, wherein said stationary cylinder member is said cylinder rod, and said movable cylinder member is said cylinder casing.

13. An in-ground lift as recited in claim 12, wherein said cylinder rod is mounted on said stationary frame by gravity.

14. An in-ground lift as recited in claim 10, wherein said stationary cylinder member is said cylinder casing, and said movable cylinder member is said cylinder rod.

15. An in-ground lift as recited in claim 14, wherein said cylinder casing is mounted on said stationary frame by gravity.

16. An in-ground lift as recited in claim 10, and further comprising a second closed cylinder unit, a second cylinder casing and second cylinder rod, a second inlet port, and a second plunger, wherein said first and second plungers are tied together so that they move together.

17. An in-ground lift, comprising:

a stationary frame;

a movable frame including a plunger having a top and bottom and a vehicle support platform mounted adjacent the top of the plunger;

a first closed and sealed cylinder unit having a top, bottom, and sides, and defining a retracted position and an extended position, wherein the top and sides of said cylinder unit are surrounded by said plunger at least in the retracted position, wherein said cylinder unit includes a first cylinder casing, a first cylinder rod extending into said first cylinder casing and projecting out of said first cylinder casing, and a fluid inlet port and an expandable fluid chamber;

wherein, as pressurized fluid enters said fluid inlet port and flows into said expandable fluid chamber, it causes said expandable fluid chamber to expand and moves said cylinder unit to its extended position, lifting said movable frame; and wherein said plunger includes a removable portion near its top, with said cylinder unit being trapped between said removable portion and said stationary frame, such that, when said removable portion is removed, said cylinder unit can be lifted intact out through the top of said plunger.

* * * * *